US006694577B2

(12) United States Patent
Di Perrero

(10) Patent No.: US 6,694,577 B2
(45) Date of Patent: Feb. 24, 2004

(54) BUCKLE FOR SAFETY BELT WITH THREE BRANCHES, IN PARTICULAR FOR SAFETY SEATS FOR CHILDREN CARRIED IN MOTOR VEHICLES AND THE LIKE

(75) Inventor: Vincenzo Buffa Di Perrero, Turin (IT)

(73) Assignee: Belt & Buckle S.r.l., Turin (IT)

( * ) Notice: Subject to any disclaimer, the term of this patent is extended or adjusted under 35 U.S.C. 154(b) by 0 days.

(21) Appl. No.: 10/217,542

(22) Filed: Aug. 14, 2002

(65) Prior Publication Data

US 2003/0056346 A1 Mar. 27, 2003

(30) Foreign Application Priority Data

Sep. 21, 2001 (EP) ..... 01122789

(51) Int. Cl.[7] ..... A44B 11/25

(52) U.S. Cl. ..... 24/642; 24/633; 24/636; 24/573.5

(58) Field of Search ..... 24/614, 615, 625, 24/629, 633, 640, 642, 636, 653, 654, 656, 662, 664, 573.5, 575, 580, 588; 280/801.1, 802, 808

(56) References Cited

U.S. PATENT DOCUMENTS

| | | | | |
|---|---|---|---|---|
| 3,523,342 A | * | 8/1970 | Spires | 24/632 |
| 3,564,672 A | * | 2/1971 | McIntyre | 24/632 |
| 3,591,902 A | * | 7/1971 | Lohr | 24/632 |
| 4,644,618 A | * | 2/1987 | Holmberg et al. | 24/630 |
| 5,033,171 A | * | 7/1991 | Kasai | 24/614 |
| 5,086,548 A | * | 2/1992 | Tanaka et al. | 24/632 |
| 5,283,933 A | * | 2/1994 | Wiseman et al. | 24/642 |
| 5,309,611 A | | 5/1994 | Wier et al. | 24/633 |
| 5,522,619 A | | 6/1996 | Collins | 280/806 |

FOREIGN PATENT DOCUMENTS

| | | |
|---|---|---|
| EP | 0 867 131 | 9/1989 |
| EP | 0 662 288 | 7/1995 |
| GB | 2 315 294 | 1/1998 |
| IT | 00245863 | 6/1998 |
| WO | WO 01/10259 | 2/2001 |

* cited by examiner

*Primary Examiner*—Anthony Knight
*Assistant Examiner*—Andre L. Jackson
(74) *Attorney, Agent, or Firm*—Keil & Weinkauf

(57) ABSTRACT

A buckle for a safety belt with three branches where one of the branches includes a rocking lever, which is pivotably connected at one end, having an opposing free end, an intermediate groove and an intermediate projection. A dependent portion or appendage of a push button is provided including a V-shaped notch with a cam surface that cooperates with the intermediate projection of the lever. When the buckle device is un-buckled, the push button is kept at a resting position by the intermediate projection of the lever movement along the cam surface and into the V-shaped notch, where the lever is prevented from rotating but is oscillated about its pivot. The arrangement of the oscillating lever during insertion of a pair of tongue members within a casting seat or cavity prevents a corresponding clamp member (pawl) from prematurely or improperly engaging a side notch of a respective tongue member until the proper alignment/insertion of the tongue members is complete at which time the lever is free to rotate (via the intermediate groove) allowing the pawl to fully engage the notch correctly. Conversely, when the push button is pressed, a spring biased ejector block extracts the tongue members from the seat or cavity of the casing and the release button is brought back into its resting position.

7 Claims, 5 Drawing Sheets

12
12.1
12.2
12.3
12.4
12.5
12.6
12.7

15
15.3
15.5
15.6
15.4
17.5
17.6

15
15.2
15.3

15
15.3
15.5
15.7
15.6
15.4
17.5
17.6

17
17.2
17.3
17.1
17.4

17
17.4
17.1

13
13.1
13.2
13.3
13.4
XVIII 13
13.1
13.2
13.3
13.4

XX
XXI
16.4
16.5
16.1

16.1
16.3
16.4

16.1
16.3
16.4
16.5

BUCKLE FOR SAFETY BELT WITH THREE BRANCHES, IN PARTICULAR FOR SAFETY SEATS FOR CHILDREN CARRIED IN MOTOR VEHICLES AND THE LIKE

The present invention relates to a buckle for a safety belt with three branches, in particular for safety seats for children carried in motor vehicles and the like.

THE PRIOR ART

A buckle of the above type is known from the Italian patent application for utility model No. TO98U 000121 filed on Jun. 30, 1998.

In the aforesaid known buckle, the structural function of mounting and guiding the buckle components is performed by a box-shaped locking casing, preferably consisting of a monolithic die-cast metal body housed in an outer shell which merely serves as a coating. This arrangement makes it possible to limit considerably the onset of play between the tongues associated to two branches of the belt and the corresponding guiding means for insertion of the tongues into the buckle, between the pawl-type locking member and the corresponding guiding means, and between the release push-button and the corresponding guiding means. In addition, also in the event of an accident, the sturdy structure of the box-shaped locking casing ensures maintenance of the correct closed condition of the buckle, and consequently of proper hitching of the safety belt. The possible yielding of the outer shell does not jeopardize proper operation of the structural and functional unit consisting of the locking casing and the release push-button.

THE PURPOSE OF THE INVENTION

However, in the aforesaid known buckle, sometimes one or more of the following drawbacks may arise:

- involuntary release, when the buckle is correctly closed, on account of the pawl-type locking member shifting backwards, in the event of violent impact of the buckle (the so-called "inertial pull-out");
- incorrect engagement of the pawl-type locking member with the tongues, which have not been completely inserted into the buckle, and consequent improper and insecure closing of the buckle; and
- faulty closing of the buckle, in the case of introduction of just one tongue into the buckle, with the consequent need to release the buckle.

The purpose of the present invention is to overcome the above-mentioned drawbacks.

Consequently, the main purpose of the present invention is to provide a buckle for a safety belt with three branches, in particular for safety seats for children carried in motor vehicles and the like, which is not subject to accidental, i.e., involuntary, release in the event of violent impact, which does not allow improper engagement of the pawl-like locking member with the tongues associated to two branches of the belt, when the tongues have not been completely inserted into the buckle, and which does not allow faulty closing of the buckle in the event of introduction into the latter of just one of said tongues.

Another purpose of the present invention is to provide a buckle as specified above which has a simplified structure, safe and reliable operation, and a relatively contained cost.

To achieve the above purposes, the present invention proposes a buckle for a safety belt with three branches, in particular for safety seats for children carried in motor vehicles and the like.

DETAILED EXAMPLE OF AN EMBODIMENT.

The following is a detailed description of an example of an embodiment of the buckle for a safety belt with three branches, in particular for safety seats for children carried in motor vehicles and the like, according to the invention, with reference to the drawings, which are provided purely by way of non-limiting example and in which.

Figures 1, 2, 3:
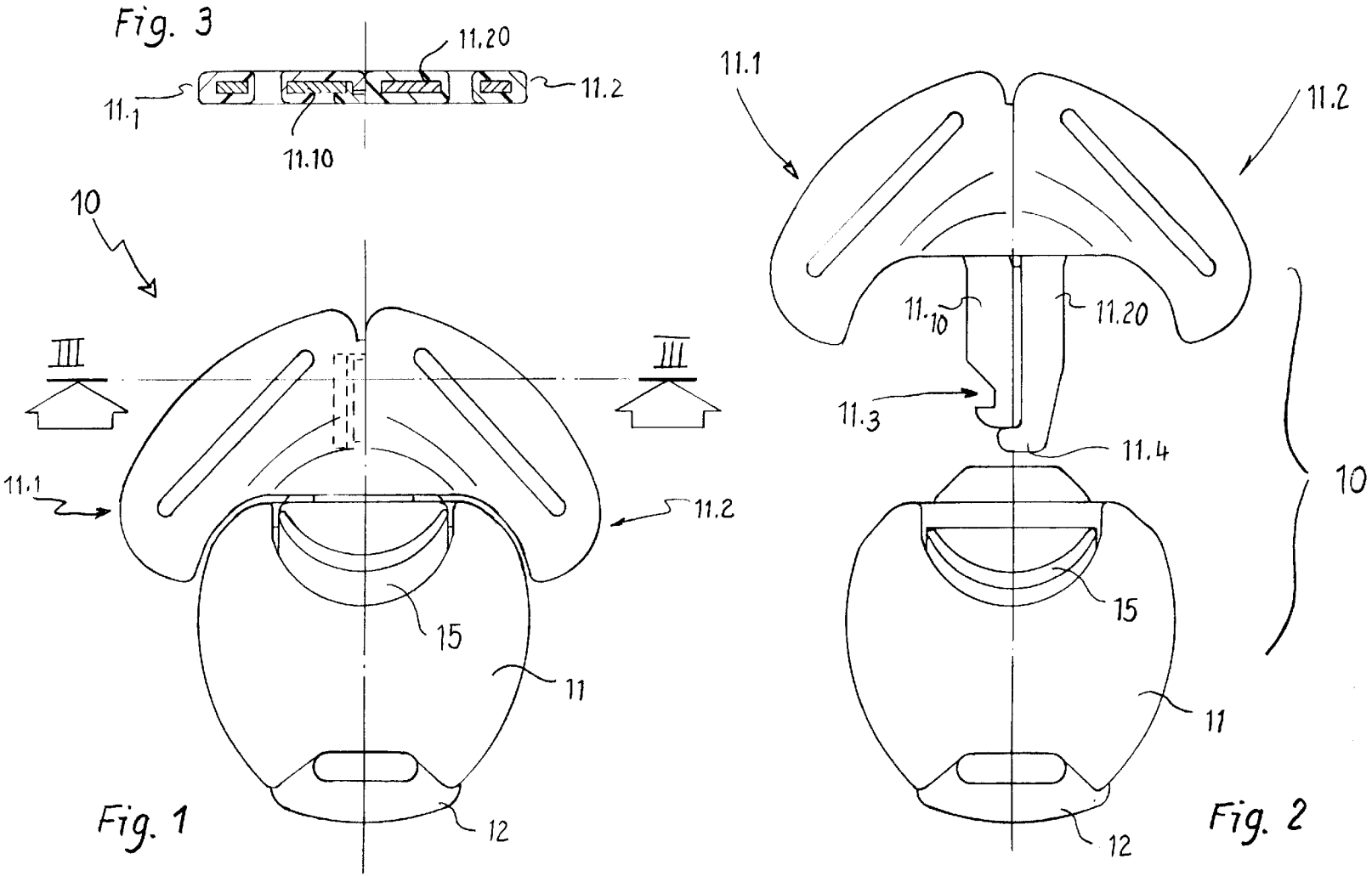
FIG. 1 is a front elevation of the buckle according to the invention, in the closed condition (belt hitched)
FIG. 2 is a front elevation of the buckle according to the invention, in the open condition and with the tongues taken out (belt unhitched)
FIG. 3 is a sectional view taken according to the line III—III of FIG. 1.

With reference to the drawings, number 10 (FIGS. 1 and 2) designates, as a whole, a buckle for a safety belt with three branches, in particular for safety seats for children carried in motor vehicles and the like, according to the present invention.

The said buckle 10 basically comprises (according to the subject of the Italian patent application for utility model No. TO98U 000121 filed on Jun. 30, 1998):

- a rigid shell 11, made up of two half-shells of plastic material, in which is partly enclosed a box-shaped locking casing 12, preferably made of metal, which is connected, by means of a slotted or eyelet part, to the free end of a branch (not illustrated) of the safety belt; and
- a pair of tongues, respectively 11.1 and 11.2, which are connected, each by means of an eyelet, to a free end of a corresponding one of the other two branches (not illustrated herein) of the safety belt and which are provided with flat shafts, 11.10 and 11.20 that are to be introduced into the locking casing 12.

Figure 10:
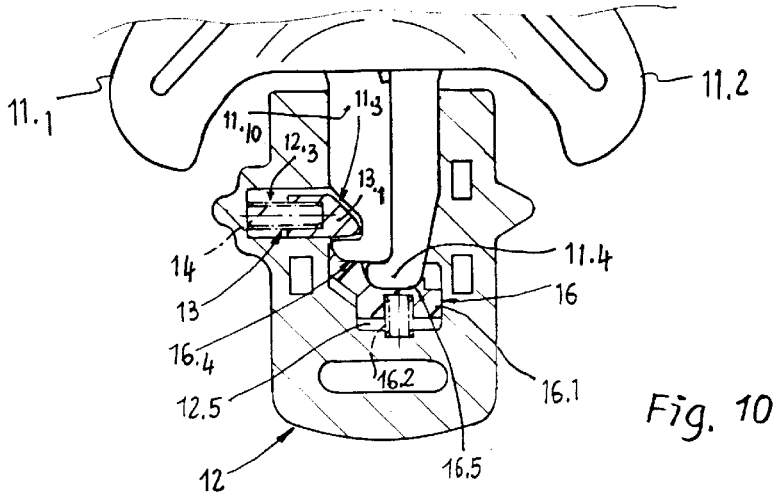
FIGS. 8 to 10 are views respectively similar to those of FIGS. 4, 6 and 7, but illustrating the buckle in the closed condition with the tongues inserted.

In particular, the first tongue 11.1 has, at the free end of its shaft 11.10 (i.e., the distal end with respect to the fixing eyelet), a side notch 11.3, while the shaft 11.20 of the outer tongue 11.2 is longer than the one of the tongue 11.1 and has its free end (i.e., the one distal with respect to the fixing eyelet) substantially shaped like a hook 11.4. In this way, when the shafts of said tongues are properly set alongside one another, as illustrated in FIGS. 2 and 10, for their insertion into the aforesaid box-shaped locking casing 12, the notch 11.3 of the first tongue is set facing outwards, while the second tongue 11.2 hooks from underneath, with its end 11.4, the first tongue 11.1. Advantageously, the box-shaped locking casing 12 consists of a monolithic body, for example one made of a die-cast metal alloy.

Figure 7:
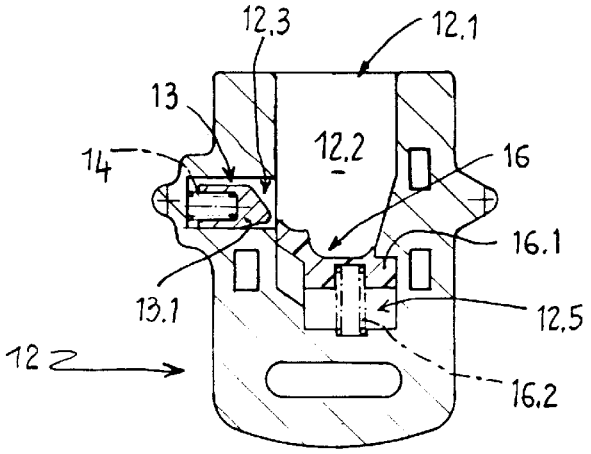
FIGS. 6 and 7 are sectional views taken, respectively, according to the lines VI—VI and VII—VII of FIG. 5.
Figure 6:
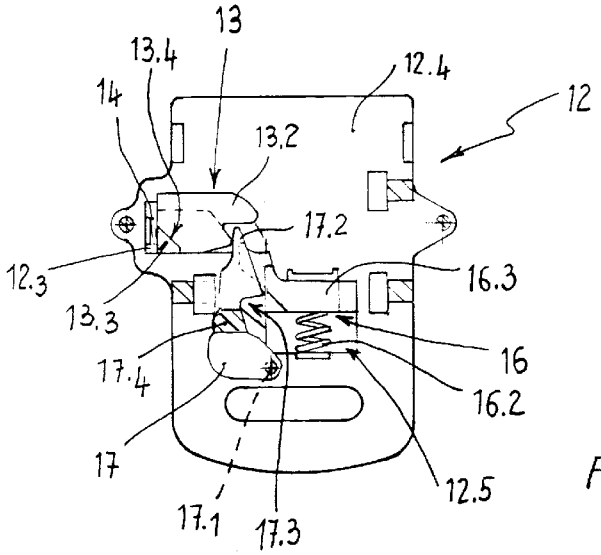
Figure 4:
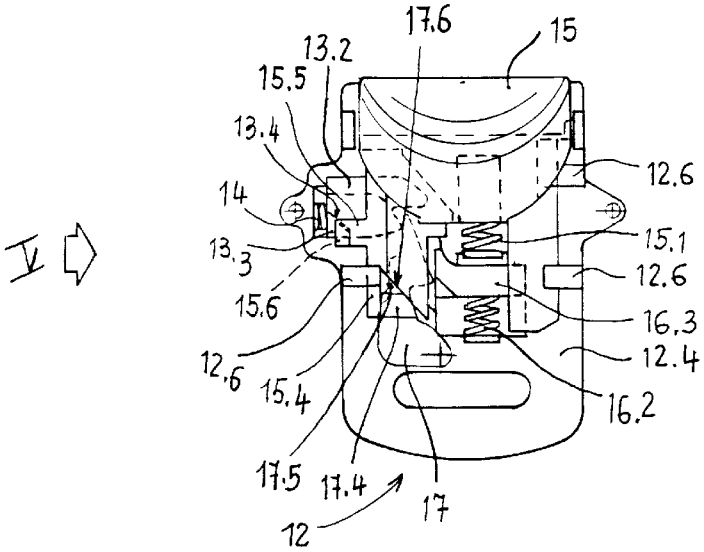
FIG. 4 is a view similar to that of FIG. 2, but with the outer shell of the buckle taken away and the tongues removed for reasons of clarity of illustration (the said view is taken in the direction of the arrow IV of FIG. 5)
Figures 11, 12, 13, 14, 15, 16, 17, 18, 19, 20, 21:
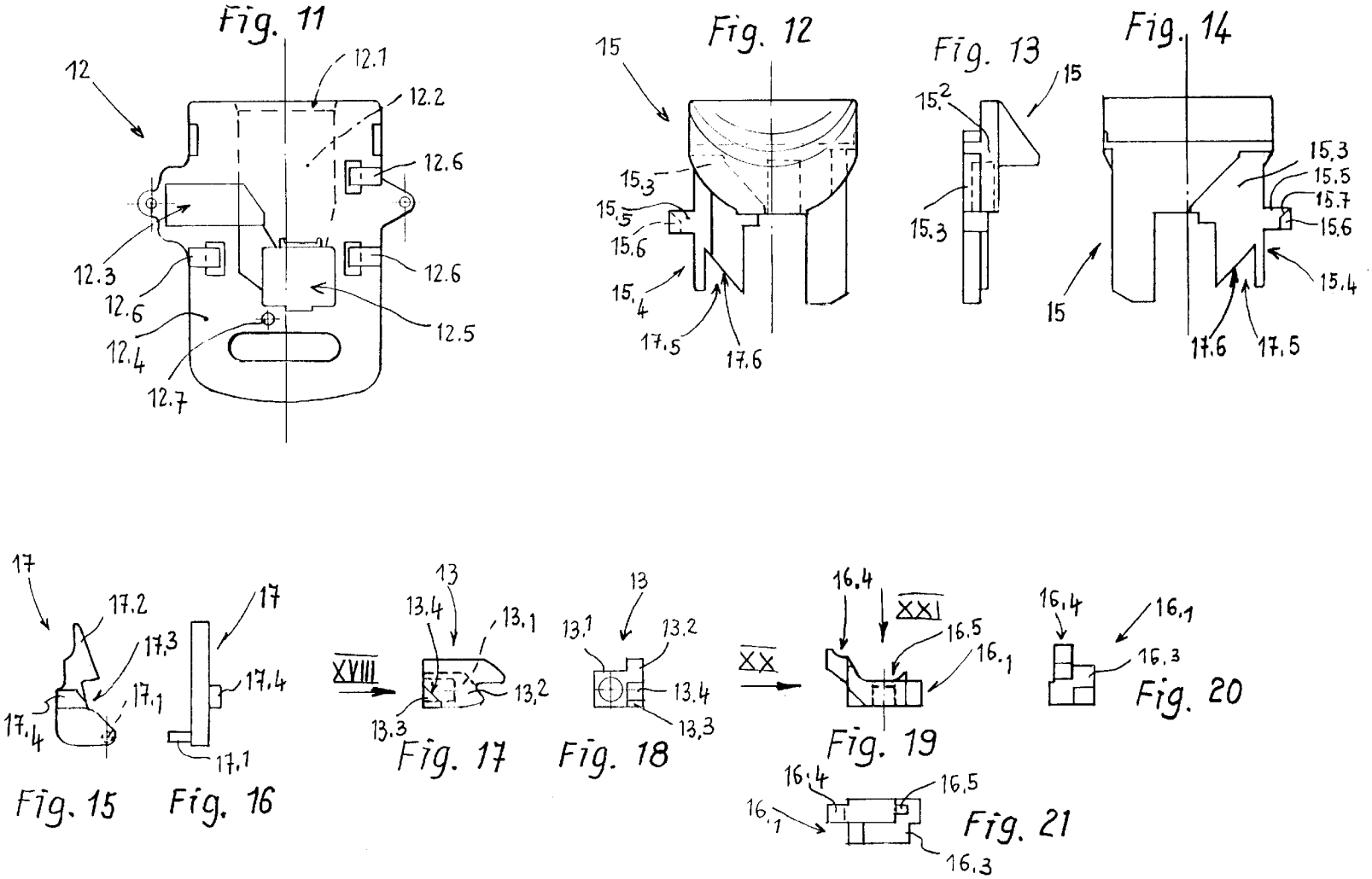
FIG. 11 is a front elevation of a box-shaped locking casing of the buckle according to the invention.
FIGS. 12, 13 and 14 are, respectively, a front elevation, a side elevation, and a rear elevation of a release button with which the buckle according to the invention is provided.
FIGS. 15 and 16 are, respectively, a front elevation and a side elevation of a lever member with which the buckle according to the invention is provided.
FIG. 17 is a front elevation of a clamping member with which the buckle according to the invention is provided.
FIG. 18 is a view in the direction of the arrow XVIII of FIG. 17.
FIG. 19 is a front elevation of an expelling member with which the buckle according to the invention is provided.
FIGS. 20 and 21 are views in the direction, respectively, of the arrow XX and of the arrow XXI of FIG. 19.

The said box-shaped locking casing 12 has three openings (FIGS. 7 and 11):

- a first opening (indicated by the arrow 12.1) provided in one of its side walls and forming a guide for proper introduction and extraction, with respect to a corresponding seat 12.2 inside the locking casing, of the shafts 11.10, 11.20, properly set alongside one another, of the aforesaid tongues 11.1, 11.2;
- a second opening 12.3 in its front wall 12.4 (FIG. 11), which communicates at the side with said internal seat 12.2 of the casing 12; and
- a third opening 12.5, again in said front wall 12.4, which communicates with the end of said internal seat 12.2 set opposite to the opening 12.1 of the box-shaped locking casing 12.

The said second opening 12.3 provides, by means of two opposed straight walls, namely a top wall and a bottom wall (FIG. 11), rectilinear slide guides to enable sliding with play of a clamping member 13 (FIGS. 7, 10, 17 and 18). The member 13 is shaped in part like a pawl 13.1, which is mobile in said opening 12.3 in the plane of the shafts 11.10, 11.20 of the tongues (FIG. 10), in a direction transverse to the direction of sliding of the shafts themselves during their insertion into the seat 12.2 through the opening 12.1, in such a way as to engage stably, following upon introduction of the shafts and also on account of the elastic action of a first spring member 14, said side notch 11.3 of the first tongue 11.1. Said first tongue 11.1 is thus kept firmly fixed against extraction, and, together with it, also the other tongue 11, with its end 11.4 hooked to the first tongue 11.1 (buckle-closed condition—FIGS. 1 and 8 to 10—in which the safety belt is properly hitched).

A release push-button 15 (FIGS. 4, 5, 8, and 12–14) is slidably mounted externally with respect to said front wall 12.4 of the box-shaped locking casing 12, by means of guides 12.6 (FIG. 11) which are fixed integrally to the locking casing 12, in a direction substantially parallel to the direction of introduction of the shafts 11.10, 11.20 of the tongues into the seat 12.2. When the release push-button 15 is pushed manually, starting from said closed condition of the buckle 10 (FIGS. 1 and 8), in which the release button 15 is further extended with respect to the shell 11, it is displaced with respect to the casing 12 downwards, in said direction and in such a way as to counter the action of a second spring member 15.1, which, when the manual action ceases and after the shafts 11.10 and 11.20 of the tongues have been extracted from the box-shaped locking casing 12, automatically brings the push-button back into a resting position, where said push-button 15 is less extended with respect to the shell 11 (buckle-open condition of the buckle 10—FIGS. 2, 4, 6, and 7). The aforesaid push-button 15 has, in one of its sides 15.2, a recess 15.3 in which there is freely received a corresponding tab or finger 13.2 of the clamping member 13, said finger being fixed integrally to the pawl 13.1 but projecting outwards with respect to said second opening 12.3 and said front wall 12.4 of the box-shaped locking casing 12.

In order to facilitate, when the button 15 is pressed, extraction of the shafts of the tongues 11.1, 11.2 from the box-shaped locking casing 12, in the third opening 12.5 of the box-shaped locking casing 12 there are provided expelling means 16, which are elastically urged and comprise a mobile block 16.1 (FIGS. 19–21), which, when the shafts 11.10, 11.20 of the tongues are properly introduced into the seat 12.2, tends to slide into said opening 12.5 in a direction parallel to that of the shafts themselves and in a way that counters the action of a third spring member 16.2, which is thus elastically pre-loaded. When the condition of disengagement of the pawl 13.1 from the notch 11.3 of the first tongue 11.1 occurs, said mobile block 16.1 is urged, on account of the elastic action of said third spring member 16.2, to slide in the opposite direction, so causing automatic expulsion of the tongues 11.1, 11.2 from the box-shaped locking casing 12. The box-shaped locking casing 12 and the release push-button 15 constitute a structural and functional unit independent of the shell 11, which mainly has a function of coating.

Figure 9:
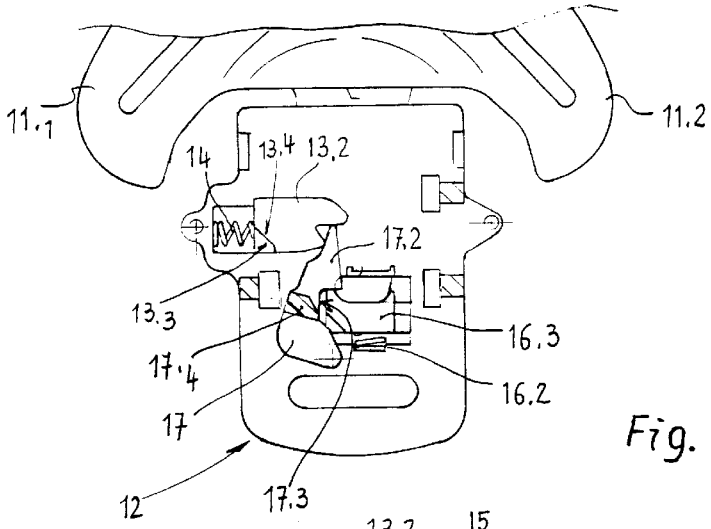
Figure 8:
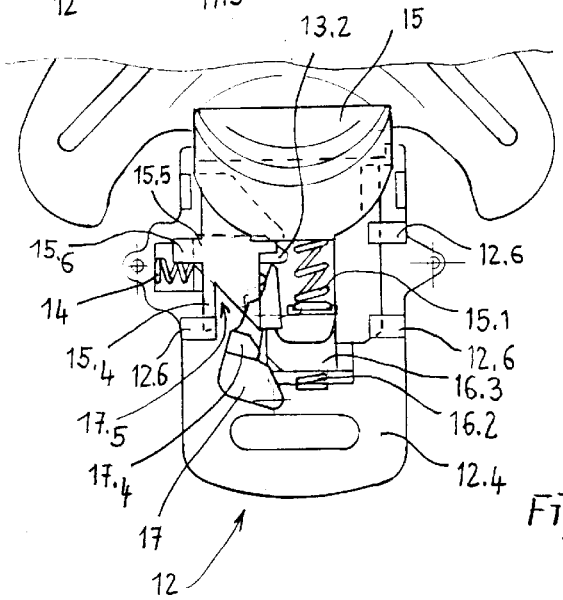

According to the present invention, set on said front wall 12.4 of the box-shaped locking casing 12 is a rocking lever 17 (FIGS. 4, 6, 8, 9, and 16), which is set between said finger 13.2 of the clamping member 13 and a front projection 16.3 of the mobile block 16.1, which protrudes with respect to a third opening 12.5 and to said front wall 12.4. Said lever 17 is hinged, at one of its ends and by means of an integral pivot 17.1 (FIG. 11), in a corresponding hole 12.7 of said front wall 12.4, in such a way that it can oscillate about an axis substantially orthogonal to the wall. In addition, said lever is set, with its other end 17.2 (FIGS. 6 and 9), which is free, in contact with or in the proximity of said finger 13.2, while it has, in its intermediate part, a groove 17.3 which can engage, in an oscillated position of the lever about said axis, said front projection 16.3 (FIGS. 8 and 9).

An intermediate projection 17.4 protrudes at the front from said lever 17, whilst in an appendage 15.4 extending from the button 15 in a direction parallel to said front wall 12.4 and overlying both said finger 13.2 and said free end 17.2 of the lever 17, there is provided a basically V-shaped notch 17.5, which, with its straight inclined side 17.6 (FIG. 12) provides a cam surface that co-operates with said projection 17.4, which has the function of a cam follower.

Furthermore, from said appendage 15.4 of the push-button 15 there extends also a side tab 15.5, which is co-planar and provided, at its free end, with a catch 15.6 (FIGS. 4, 8, 12, and 14) extending towards said front wall 12.4 and having a chamfered side 15.7, so as to provide a surface inclined roughly at 45° with respect to the direction of sliding of the shafts of the tongues 11.1, 11.2 when the latter are properly set alongside one another with respect to the seat 12.2.

In a corresponding way, in the end area of said finger 13.2 opposite to the end 17.2 of the lever 17 there is provided a groove 13.3 which has an inclined side 13.4 (FIGS. 6, 9, 17, and 18) oriented in a direction parallel to said side 15.7 of said catch 15.6.

Thanks to the above arrangement, when the buckle 10 is in the open condition (belt unhitched—FIGS. 2, 4, 6, and 7), the push-button 15, urged by said second spring member 15.1, is kept in the above-mentioned resting position, in which the front intermediate projection 17.4 of the lever 17 engages the cam surface 17.6 at end of travel in the V-shaped notch 17.5 (FIG. 4), whilst the catch 15.6 is received in said groove 13.3 of the finger 13.2, thus preventing the push-button itself from further sliding in extension with respect to the shell 11, under the action of said second spring member 15.1. The lever 17 is thus prevented from rotating and is kept oscillated about the axis of the pivot 17.1, so as to push said finger 13.2, integral with the pawl 13.1, to the end of travel in the resting position with respect to said second opening 12.3 (i.e., it is set back at the maximum distance from the seat 12.2 of the box-shaped locking casing 12). In addition, said block 16.1 of the expelling means 16 is elastically urged by said third spring member 16.2 into the end-of-travel position towards the seat 12.2, whilst with one of its sides it rests against the free end 17.2 of said lever 17. When the shafts of the tongues 11.1, 11.2, properly set alongside one another, are introduced through said first opening 12.1 into the seat 12.2, they engage said block 16.1, causing it to slide so that it counters the action of said third spring member 16.2. Said block 16.1 slides, first, with one of its sides in contact with the free end 17.2 of the lever 17, keeping the latter in the aforesaid oscillated position, and this prevents the pawl 13.1 from engaging too soon, and hence improperly, the side notch 11.3 of the tongue 11.1 which is being inserted into the seat 12.2. Subsequently (FIGS. 8–10), as sliding of the tongues proceeds, when said block 16.1 roughly reaches the end of its travel that counters the action of said third spring means 16.2, it sets itself in a position corresponding to the intermediate groove 17.3 of the lever 17, which is no longer prevented from oscillating about the axis of its own pivot 17.1 and, by oscillating, enables said finger 13.2 to slide, integrally with the pawl 13.1 in the opening 12.3, towards the shafts of the tongues 11.1, 11.2 inserted in said seat 12.2.

It should be noted that said finger 13.2, with the pawl 13.1 integral with it, is urged to slide as indicated on account of the combined action of the following: (1) said second spring member 15.1, which, by means of the sliding coupling of the opposed inclined sides 15.7/13.4 respectively of the catch 15.6 of the push-button 15 and of the groove 13.3 of the finger 13.2, indirectly urges said finger 13.2; and (2) said first spring member 14, which urges said finger 13.2 directly.

Said lever 17 is thus made to describe an arc of rotation, overlying said projection 16.3 of the block 16.1. At the same time, said pawl 13.1 slides as far as its end-of-travel in said second opening 12.3 towards said seat 12.2 and engages fully the side notch 11.3 of the tongue 11.1, which is properly inserted inside the seat 12.2 together with the other tongue 11.2, thus achieving the condition of correct and stable closing of the buckle 10. In addition, said finger 13.2, sliding integrally with the pawl 13.1, disengages the catch 15.6 and enables the push-button 15 to slide, urged by said second spring member 15.1, as far as its completely extended position with respect to the shell 11. In this condition, said catch 15.6 sets immediately behind said finger 13.2 and consequently prevents even partial recession of the pawl 13.1 which is integral with said finger 13.2 (this arrangement prevents in a reliable way the problems linked to the so-called "inertial pull-out" of the buckle 10—FIGS. 1 and 8 to 10).

If the push-button 15 is now pressed, so countering the action of said second spring member 15.1, its cam surface 17.6 engages said intermediate projection 17.4 of the lever 17, causing the lever to oscillate in the reverse direction about the axis of its pivot 17.1. In this way, the aforesaid lever 17 releases the block 16.1 of the expelling means 16 which, being urged by said third spring member 16.2, push the tongues 11.1, 11.2 out of the seat 12.2 of the box-shaped locking casing 12. At the same time, said catch 15.6, moving integrally with the push-button 15, is displaced with respect to the finger 13.2 and releases it; this enables the pawl 13.1 to perform its reverse travel of complete recession in said opening 12.3, disengaging the side notch 11.3 of the tongue 11.1, which is thus released together with the other tongue 11.2.

It should be noted that the aforesaid reverse travel of recession of the pawl 13.1, in a way that counters the action of the first spring member 14, is determined by said reverse oscillation of the lever 17, the free end 17.2 of which rests and pushes against said finger 13.2.

The buckle 10 is thus opened, the tongues 11.1 and 11.2 extracted, and the release push-button 15 brought back into its resting position.

Furthermore, according to the present invention, said block 16.1 of the expelling means 16, has in a position set in front of said seat 12.2 of the box-shaped locking casing 12, two steps (respectively 16.4, 16.5—FIGS. 10, 22 and 23), set in such a way that, when the shafts 11.10, 11.20 of the tongues 11.1, 11.2 are properly set alongside one another and inserted into said seat, a foot of a respective shaft rest on the one (11.10/16.4) and on the other (11.20/16.5) of said steps, while said tongues push said block in a way that counters the action of said third spring member 16.2 (FIG. 10).

Figure 22:
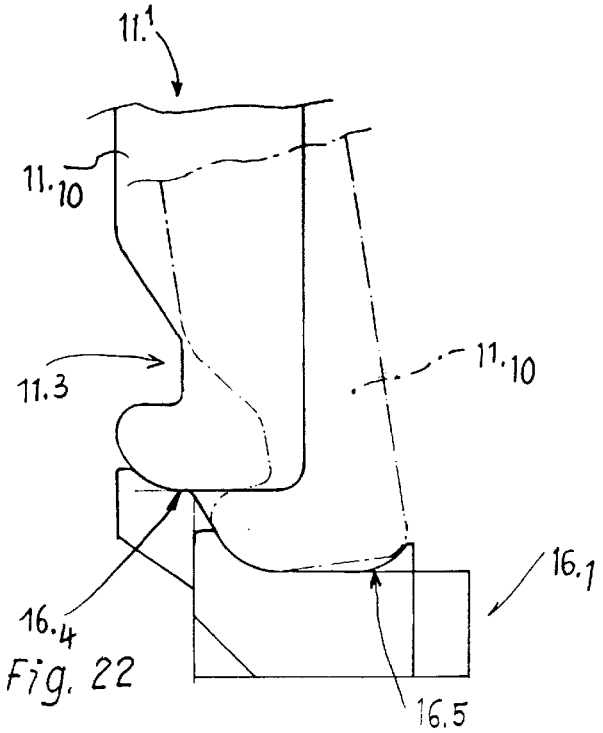
FIGS. 22 and 23 are detailed schematic views, at a larger scale, respectively illustrating the way of positioning of each tongue in the buckle, when inserted alone into the buckle so that it rests against the expelling member according to FIG. 19.
Figure 23:
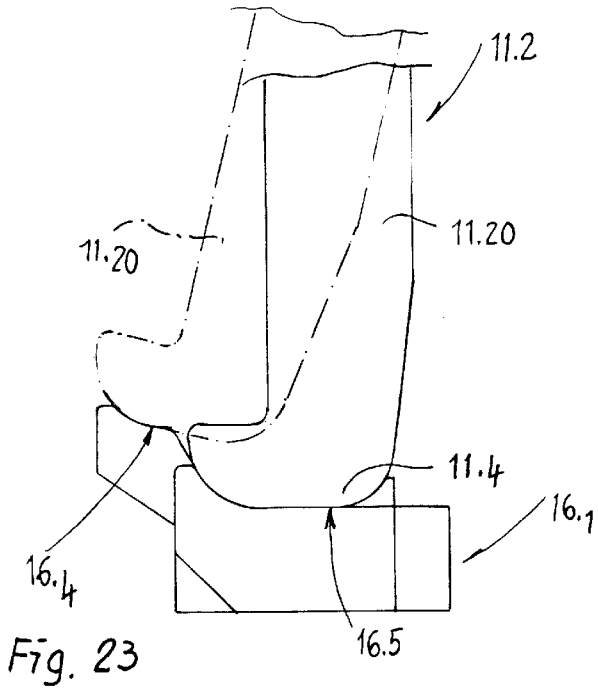
Figure 5:
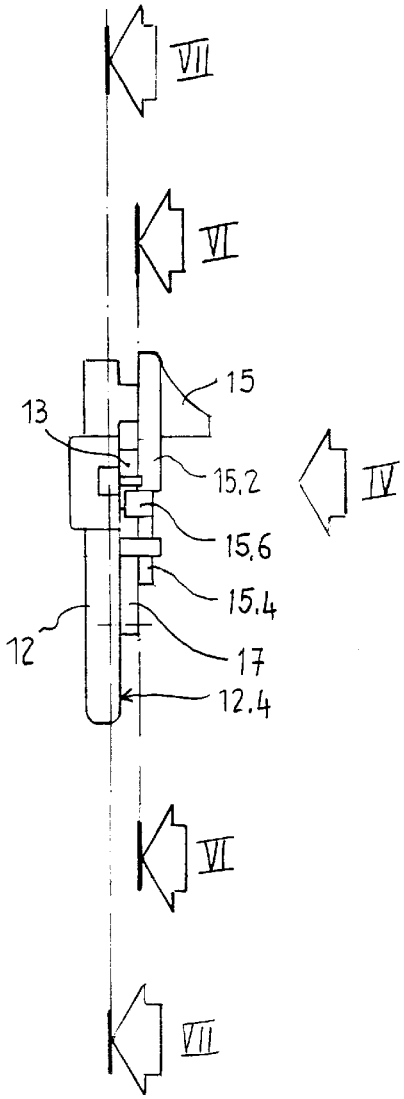
FIG. 5 is a side elevation in the direction indicated by the arrow V of FIG. 4.

In particular, each of said steps 16.4, 16.5 has a resting surface of the respective foot of tongue shaped at least in part according to a curvilinear pattern degrading towards the inside of the block 16.1, so that when just one tongue 11.1 or 11.2 is inserted into the seat 12.2 of the box-shaped locking casing 12, the foot of its shaft (which is not supported by the shaft of the other tongue set alongside) rests and slides on the respective step 16.4, 16.5 of the block 16.1, settling itself obliquely in said seat (as illustrated by dashed-and-dotted lines in FIGS. 22 and 23). In this way, introduction of the shaft of just one tongue 11.1 or 11.2 into said seat 12.2 does not bring about the travel of operation of said block 16.1 in said third opening 12.5 in a way that counters the action of said third spring member 16.2 until the block 16.1 rests its projection 16.3 in a position corresponding to the intermediate groove 17.3 of the lever 17. Consequently, the lever 17 can not oscillate towards said block 16.1 and, instead, keeps the pawl 13.1 completely set back in its resting position, thus preventing any undesired faulty closing of the buckle 10.

In particular, each of said steps 16.4, 16.5 has a resting surface of the respective foot of tongue shaped at least in part according to a curvilinear pattern degrading towards the inside of the block 16.1 itself, so that when just one tongue 11.1 or 11.2 is inserted into the seat 12.2 of the box-shaped locking casing 12, the foot of its shaft (which is not supported by the shaft of the other tongue set alongside) rests and slides on the respective step 16.4, 16.5 of the block 16.1, setting itself obliquely in said seat (as illustrated by dashed-and-dotted lines in FIGS. 22 and 23). In this way, introduction of the shaft of just one tongue 11.1 or 11.2 into said seat 12.2 does not bring about the travel of operation of said block 16.1 in said third opening 12.5 in a way that counters the action of said third spring member 16.2 until it rests its projection 16.3 in a position corresponding to the intermediate groove 17.3 of the lever 17. Consequently, the lever 17 cannot oscillate towards said block 16.1 and, instead, keeps the pawl 13.1 completely set back in its resting position, thus preventing any undesired faulty closing of the buckle 10.

What is claimed:

1. A buckle for a safety belt with three branches comprising:

a box-shaped locking casing (12), connected to the end of one branch of the safety belt and housed in a shell (11);

a pair of tongues (11.1, 11.2), each connected to the end of a corresponding one of the other two branches of the safety belt and provided with flat shafts (11.10, 11.20) that are to be introduced into the locking casing (12), one of said tongues (11.1) having a side notch (11.3);

a seat (12.2) in the box-shaped locking casing (12), which is provided with a first opening (12.1) forming a guide for correct insertion and extraction of the tongues, properly set alongside one another, into/from the seat;

a clamping member (13) including a pawl (13.1), which is slidably housed in a second opening (12.3) of the box-shaped locking casing and communicates with the seat (12.2) for engaging the side notch (11.3) of one of the tongues that have been set alongside one another and inserted fully into the seat (12.2), keeping the said tongues firmly fixed against extraction (buckle-closed condition);

a release push-button (15), which is able to slide with respect to the box-shaped locking casing (12) and which is urged by an elastic means (15.1) and, in the buckle-closed condition, extends further with respect to the shell (11) than in the open condition of the buckle;

expelling means (16) including a block (16.1) which is mobile in a third opening (12.5) of the box-shaped locking casing (12) communicating with the seat (12.2) and is urged by another elastic means (16.2) to slide towards the seat and which, when the tongues are inserted into said seat properly set alongside one another, is made to slide in a direction parallel to the direction of insertion of the tongues, in a way that counters the action of said other elastic means (16.2), the improvement wherein the buckle further comprises:

a rocking lever (17) which is hinged at one end (pivot 17.1) with respect to said box-shaped locking casing (12) and is set, with its opposite end (17.2), which is free, between a finger (13.2) that is integral with said pawl (13.1) of the clamping means (13) and a projection (16.3) of said mobile block (16.1) of the expelling means (16) and which has an intermediate groove (17.3) that engages, in an oscillated position of the lever, said projection (16.3) of the block (16.1), and an intermediate projection (17.4); and an appendage (15.4) of the push-button (15), which overlies both said finger (13.2) of the clamping means (13) and said free end (17.2) of the lever (17) and is provided with a roughly V-shaped notch (17.5) which, with an inclined straight side (17.6), provides a cam surface that cooperates with said projection (17.4) of the lever (17), which has the function of a cam follower, in such a way that:

when the buckle (10) is in the open condition, whereby the belt is unhitched, said push-button (15), urged by the elastic means (15.1) is kept in a resting position, in which the intermediate projection (17.4) of the lever (17) engages the cam surface (17.6) at its end of travel in the V-shaped notch (17.5); the lever (17) is prevented from rotating and is kept oscillated about its fulcrum (pivot 17.1), so as to push said finger (13.2) to an end of travel in a resting position with respect to said second opening (12.3), and said block (16.1) of the expelling means (16) is elastically urged by said other elastic means (16.2) into an end-of travel position towards the seat (12.2), such that one side of the block 16.3 rests against the free end 17.2 of said lever 17; while when the shafts of the tongues (11.1, 11.2), properly set alongside one another, are introduced through said first opening (12.1) into the seat (12.2), they engage said block (16.1), causing it to slide so that it counters the action of said other elastic means (16.2), in contact with the free end (17.2) of the lever (17), keeping the such that one side of the block 16.3 rests against the free end 17.2 of said lever 17 in the aforesaid oscillated position, and this prevents the pawl (13.1) from engaging too soon, and hence improperly, the side notch (11.3) of one (11.1) of the tongues which are being inserted into the seat (12.2), and subsequently, as sliding of the tongues proceeds, when said block (16.1) roughly reaches the end of its travel that counters the action of said other elastic means (16.2), said block sets in a position corresponding to the intermediate groove (17.3) of the lever (17), which, being no longer prevented from oscillating about the axis of its own fulcrum (pivot 17.1), enables said finger (13.2) to slide, integrally with the pawl (13.1) in the opening (12.3), towards the shafts of the tongues (11.1, 11.2) inserted in said seat (12.2); said lever (17) is thus made to describe an arc of rotation, overlying said projection (16.3) of the block (16.1), while said pawl (13.1) slides as far as its end-of-travel in said second opening (12.3) towards said seat (12.2) and engages fully the side notch (11.3) of one of the tongues, which are properly inserted inside the seat, thus achieving the condition of correct and stable closing of the buckle (10); and conversely, when the push-button (15) is pressed, so countering the action of said elastic means (15.1), its cam surface (17.6) engages said intermediate projection (17.4) of the lever (17), causing the lever to oscillate in the reverse direction about its fulcrum (pivot 17.1); the aforesaid lever (17) thus releases the block (16.1) of the expelling means (16) which, being urged by said other elastic means (16.2), push the tongues (11.1, 11.2) out of the seat (12.2) of the box-shaped locking casing (12); the buckle (10) is thus opened, the tongues (11.1, 11.2) extracted, and the release push-button (15) brought back into its resting position.

2. The buckle for a safety belt according to claim 1, characterized in that it comprises a catch (15.6), integral with said push-button (15), extending towards said box-shaped locking casing (12) and having a chamfered side (15.7), so as to provide an inclined surface with respect to the direction of sliding of the shafts of the tongues (11.1, 11.2) when the tongues are properly set alongside one another with respect to the seat (12.2), as welt as, in the end area of said finger (13.2) of the clamping member (13) opposite to the free end (17.2) of the lever (17), a groove (13.3) having an inclined side (13.4) oriented in a direction roughly parallel to said side (15.7) of the catch (15.6), in such a way that:

when the push-button (15), urged by said elastic means (15.1), is kept in a resting position, the catch (15.6) is received in said groove (13.3) of the finger (13.2), thus preventing the push button from further sliding in extension with respect to the shell (11), under the action of the elastic means (15.1) whilst, when the aforesaid finger (13.2) of the clamping member (13) slides integrally with the pawl (13.1) towards the seat (12.2), it disengages the catch (15.6) and enables the push-button (15) to slide, urged by said elastic means (15.1), as far as its completely extended position with respect to the shell (11) wherein the belt is unhitched with the buckle closed and, in the aforesaid condition, said catch (15.6) sets itself immediately behind said finger (13.2) of the clamping member (13.1) and prevents even partial recession of the pawl (13.1); thereby preventing inertial pull-up of the buckle 10; while, when subsequently the push-button (15) is pressed in a way that counters the action of said elastic means (15.1), said catch (15.6) moving integrally with the push-button (15), is displaced with respect to the finger (13.2) of the clamping member (13) and releases it; this enables the pawl (13.1) to perform its travel of complete recession in said opening (12.3), disengaging the side notch (11.3) of the tongue (11.1), which is thus released together with the other tongue (11.2).

3. The buckle for a safety belt according to claim 2, characterized in that said finger (13.2) of the clamping member (13) is urged to slide integrally with the pawl (13.1) towards said seat (12.2) on account of the combined action of the following: (a) said elastic means (15.1), which, by means of the sliding, coupling of the opposed inclined sides (15.7/13.4) respectively of the catch (15.6) of the push-button (15) and of the groove (13.3) of the finger (13.2), indirectly urge said finger (13.2); and (b) further elastic means (14), which urge said finger (13.2) directly.

4. The buckle for a safety belt according to claim 2 or 3, characterized in that the travel of recession of the pawl (13.1), in a way that counters the direct action of said further elastic means (14), is determined by said reverse osicillation of the lever (17), the free end (17.2) of which rests and pushes against said finger (13.2).

5. The buckle for a safety belt according to claim 1, characterized in that said block (16.1) of the expelling means (16) has, in a position set in front of said seat (12.2) of the box-shaped locking casing (12), two steps (16.4, 16.5), set in such a way that, when the shafts of the tongues (11.1, 11.2) are properly set alongside one another and inserted into said seat, a foot of a respective shaft rest on the one (11.1/16.4) and on the other (11.2/16.5) of said steps, whilst said tongues push said block in a way that counters the action of said other elastic means (16.2).

6. The buckle for a safety belt according to claim 5, characterized in that each of said steps (16.4, 16.5) has a resting surface of the respective foot of tongue shaped at least in part according to a curvilinear pattern degrading towards the inside of the block (16.1), so that when just one tongue (11.1 or 11.2) is inserted into the seat (12.2) of the box-shaped locking casing (12), the foot of its shaft rests and slides on the respective step (16.4, 16.5) of the block (16.1), setting itself obliquely in said seat, and does not cause sliding of said block (16.1) in said opening (12.5), in a way that counters the action of said other elastic means (16.2), thus preventing undesirable faulty closing of the buckle (10).

7. The buckle of claim 1 wherein it is employed in a motor vehicle for a safety seat for a child.

* * * * *

UNITED STATES PATENT AND TRADEMARK OFFICE

CERTIFICATE OF CORRECTION

PATENT NO. : 6,694,577 B2
DATED : February 24, 2004
INVENTOR(S) : Vincenzo Buffa Di Perrero It is certified that error appears in the above-identified patent and that said Letters Patent is hereby corrected as shown below:

Column 8,
Line 60, “as welt as” should be -- as well as --.

Column 10,
Line 4, “osicillation” should be -- oscillation --.

Signed and Sealed this

Eighth Day of June, 2004

JON W. DUDAS
*Acting Director of the United States Patent and Trademark Office*